US011477566B1

(12) United States Patent
Crocker

(10) Patent No.: US 11,477,566 B1
(45) Date of Patent: Oct. 18, 2022

(54) TONE WOOD HEADPHONE CUP

(71) Applicant: Anthony James Crocker, Tulsa, OK (US)

(72) Inventor: Anthony James Crocker, Tulsa, OK (US)

( * ) Notice: Subject to any disclaimer, the term of this patent is extended or adjusted under 35 U.S.C. 154(b) by 0 days.

(21) Appl. No.: 17/067,182

(22) Filed: Oct. 9, 2020

(51) Int. Cl.
*H04R 25/00* (2006.01)
*H04R 1/10* (2006.01)
*G10D 9/047* (2020.01)

(52) U.S. Cl.
CPC ..... *H04R 1/1075* (2013.01); *G10D 9/047* (2020.02); *H04R 1/1091* (2013.01); *H04R 2201/025* (2013.01)

(58) Field of Classification Search
CPC .. H04R 1/1058; H04R 1/1008; H04R 1/2811; H04R 1/1083; H04R 1/1066; H04R 1/08; H04R 1/1041; H04R 3/04; H04R 5/02; H04R 2201/107; H04R 2460/11
See application file for complete search history.

(56) References Cited

U.S. PATENT DOCUMENTS 3,999,020 A * 12/1976 Bastiaans ..... H04R 1/1041 381/372
5,991,422 A * 11/1999 Chiang ..... H04R 1/1033 381/384

OTHER PUBLICATIONS

Wilson, Trav "Introduction to Grado Modifications" Feb. 12, 2018 https://www.headphonesty.com/2018/02/introduction-grado-modifications-ear-cups-driver/.*

* cited by examiner

*Primary Examiner* — Amir H Etesam

(57) ABSTRACT

A headphone ear cup holds the transducer. This patent focuses on applying tone wood porting theory to the headphone cup. Simply put, tone wood theory states that certain woods provide a tonality to the music. The practice of speaker porting has been in use for many years to extend the bass response of a speaker. By combining tone woods with porting, a more musical presentation created than by using a polymer or metal cup.

4 Claims, 3 Drawing Sheets

3D of tone wood cup and mounting ring

Figure 1: 3D of tone wood cup and mounting ring
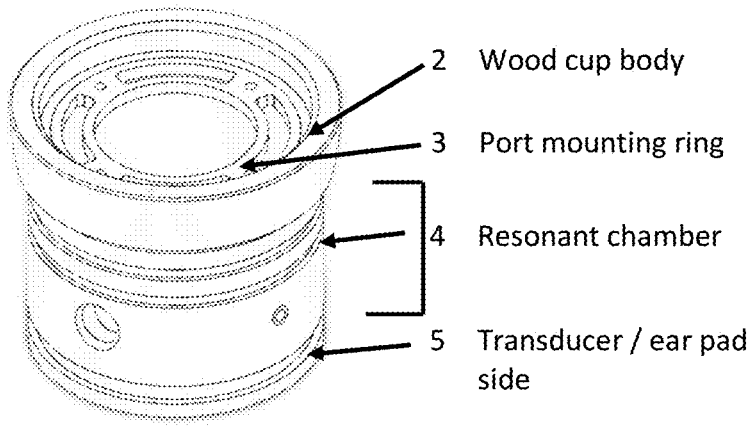
Figure 2: 3D view of cup with tone wood port installed
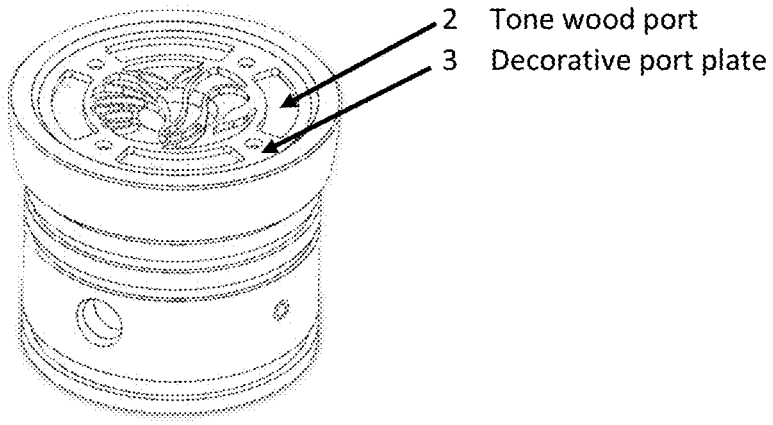

Figure 3: Tone wood port
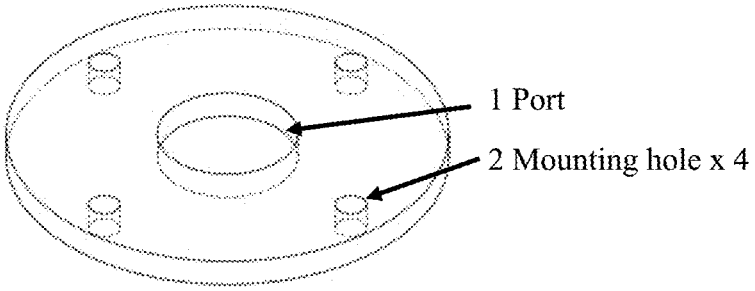
Figure 4: Closed back headphone example
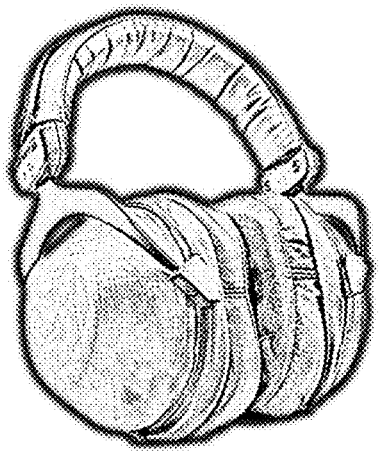

Figure 5: Open back headphone example
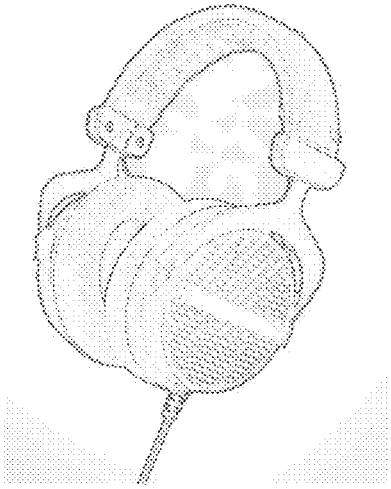
Figure 6: Ported headphone example, single side shown
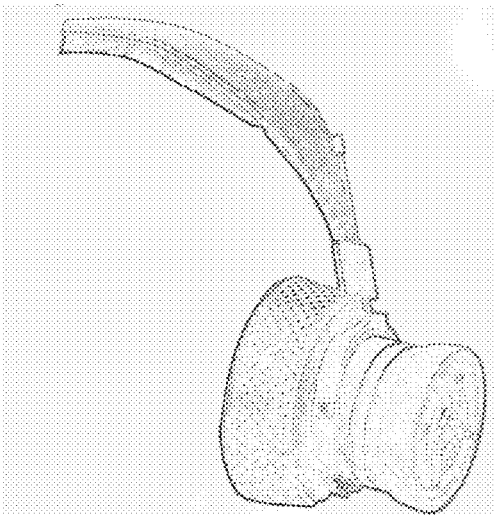

TONE WOOD HEADPHONE CUP

STATEMENT REGARDING FEDERALLY SPONSORED RESEARCH OR DEVELOPMENT

This invention was not made with government support.

FIELD OF CLASSIFICATION

USPC 381/63, 381/118, 381/337, 381/345
CPC H04R 1/10, H04R 1/20, H04R 1/1008, H04R 1/2823, H04R 1/2846, H04R 2201/02, H04R 2460/11

REFERENCES CITED

U.S. Patents most closely related:
U.S. Pat No. 9,479,855 October 2016 Merry Electronics
U.S. Pat No. 9,426,555 August 2016 Ever Win International Corporation
U.S. Pat No. 8,295,531 October 2012 Lin
U.S. Pat No. 6,658,121 December 2003 Konig
U.S. Pat No. 5,729,605 March 1998 Bobisuthi et al.
U.S. Pat No. 3,999,020 December 1976 Bastiaans et al.
U.S. Pat No. 5,555,554 September 1996 Hofer; Alan
U.S. Pat No. 10,165,348 December 2020 Kirsch; James
U.S. Pat No. 10,034,086 July 2018 Bose Corporation
U.S. Pat No. 10,171,905 January 2019 Wen; Tseng Feng

TECHNICAL FIELD

The disclosure is related to sound reproduction headphones using either over the ear or on the ear pads. This disclosure does not apply to "In Ear Monitors" that are placed inside the listener's ear. This does not apply to Ear Muffs which are meant for hearing protection.

BACKGROUND

Headphones can be categorized into the following groups:

1 External passive headphones for listening to sound reproduction.
2 External active noise canceling headphones for listening to sound reproduction.
3 Ear muffs or ear protectors used to keep external sounds from reaching the user's ears.
4 In Ear Monitors which includes ear buds and ear phones that are placed inside the user's ear cannel.

In relation to the first 2 groups, a headphone cup holds the transducer. Cups can be categorized as follows:

1. Closed back where the cup is a sealed unit and sound is kept within the cup (FIG. 4).
2. Open back where the back side of the transducer is exposed to the external environment. Sound is not kept within the cup (FIG. 5).
3. Minimalist whereby the cup is a ring to hold the transducer and to connect to a headphone band.

More theory will be provided in the detailed section to aid the reader in understanding how the proposed headphone cup is different and why these differences are important to the design.

SUMMARY

Headphones construction bears similarities to speaker construction. The open back is like an electrostatic speaker. The closed back is like a sealed speaker.

What being proposed is a new category. The ported headphone has a resonant chamber behind the driver but it is also partially open to the external world. In essence it has elements of both the open back and closed back headphone.

BRIEF DESCRIPTION OF THE DRAWINGS

The aspects on the Tone Wood Headphone (referred to as TWH in the remainder of the document) may be more completely understood in consideration of the following detailed descriptions of the included figures.

FIG. 1:
This a 3d rending of a TWH. In it the following elements are seen.

1 The body is constructed of wood. This image is a round model for ease of manufacturing. However, a wood closed back like FIG. 4 could be employed.
2 Inside the end farthest from the listeners ear is a mounting ring for the port.
3 The resonant chamber lies between the back of the transducer and the ported wall
4 The transducer is mounted on the end of the body closest to the listeners ear.

FIG. 2:
This is a 3D rendering of the TWH with the port installed.

1 This is the tone wood port attached to the mounting ring.
2 The decorative attachment protects the port and provides a mounting point for the fasteners.

FIG. 3:
This is the tone wood port.

1 The port hole through which the headphone breathes is in the center.
2 There are four fastener holes that align with the mounting ring.

FIG. 4:
This is an example of a closed back headphone. The transducer is mounted close to the headphone pads. The chamber behind the transducer is empty.

FIG. 5:
This is an open back headphone. There may be a thin breathable membrane between the back of the transducer and the grill. Sound emanates out of the front of the transducer into the ear. At the same time, sound emanates out back of the transducer into the outside environment.

FIG. 6:
This is a ported headphone. Like the closed back headphone, the transducer is mounted at the base of the headphone pad. The back of the cup has a port. This is the same cup in FIGS. 1 and 2.

While the aspects of the disclosure are amenable to various modifications and alternative forms, specifics thereof have been shown by way of example in the drawings and will be described in detail. It should be understood, however, that the intention is not to limit aspects of the disclosure to the particular embodiments described. On the contrary, the intention is to cover all modifications, equivalents, and alternatives falling within the spirit and scope of the disclosure.

DETAILED DESCRIPTION

For the following defined terms, these definitions shall be applied, unless a different definition is given in the claims or elsewhere in this specification.

Some suitable dimensions, ranges and/or values pertaining to various components, features and/or specifications are disclosed, one of skill in the art, incited by the present disclosure, would understand desired dimensions, ranges and/or values may deviate from those expressly disclosed.

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

The following detailed description should be read with reference to the drawings in which similar elements in different drawings are numbered the same. The detailed description and the drawings, which are not necessarily to scale, depict illustrative embodiments and are not intended to limit the scope of the disclosure. The illustrative embodiments depicted are intended only as exemplary. Selected features of any illustrative embodiment may be incorporated into an additional embodiment unless clearly stated to the contrary.

To understand the design of the TWH, the user must have basic understanding of:

1. Current headphone theory
2. Speaker theory
3. Tone woods

Current Headphone Theory

Conventional headphone theory is based on the belief that the listener's ear is the environment in which sound develops. This thinking has led to the standard style of closed back headphone seen in patent U.S. Pat. No. 9,479,855.

Building on this theory are methods to adjust the transducer (U.S. Pat. Nos. 9,426,555, 8,295,531).

Others have attempted to alter the ports built into the transducer or add port piping (U.S. Pat. Nos. 3,999,020, 10,034,086).

One patent does look at the variable porting of the chamber. But this is more of a novelty and does not take into account ported speaker theory (U.S. Pat. No. 10,165,348).

Speaker Theory

There are three groupings of speakers:

1. Electrostatic where an electrical charged membrane is mounted on a frame and vibrates. This is like an open back planer or electrostatic headphone.
2. Sealed box containing one or more transducers. This is like a closed back headphone.
3. Ported box containing one or more transducers along with one or more ports.

Expounding upon speaker theory there should be another type of headphone, ported. A ported speaker uses a port to increase the efficiency of a speaker. The speaker cabinet functions similar to a pair of bellows. The port brings air and out of a chamber aiding in the movement of the transducer. The volume of the chamber and porting being dependent on the electrical and volumetric characteristics of the transducer(s).

Tone Woods

Simply put a tone wood is a wood used in the creation of music and has a desirable acoustic affect. This is why wood based musical instruments utilize certain woods and not others. For example, consider this list of woods listed from brightest to darkest sounding:

1. Maple (brightest)
2. Cherry
3. Mahogany
4. Walnut
5. Rosewood (darkest)

With this theoretical understanding, the TWH can be looked at in terms of construction and features:

Construction

According to ported speaker theory the volume of the cabinet is directly related to the electrical and volumetric characteristics of the transducer(s). This is where the TWH differs from other headphone porting attempts (U.S. Pat. No. 10,165,348).

The TWH body can be a cylinder like FIG. 1 or a closed back like FIG. 4. But in order for the chamber behind the driver to efficiently assist the transducer in it's movements, a certain amount of air volume is required behind the driver in the chamber. Therefore, chamber size is based on the driver used and desired frequency response not on ergonomics or novelty.

Secondly ported theory dictates the size of the port. Port volume is based on the desired frequency response. In the TWH the port sizes are predetermined and provided to the user. In the case of FIGS. 1 and 2 the user selects from a provided set of ports shown in FIG. 3. This could also be done with a series of port holes and port plugs or even port pipes. If the user is not interested in the tone wood affect but merely the ported affect.

The second part of the construction is the usage of tone woods. A TWH is by definition a wood headphone. It is the desired acoustical characters of the wood that cause the selection of cup material. Similar to an acoustic guitar or cello, the volume of the cup and wood utilized create a resonant chamber. A larger body allows for a lower frequency response and the greater sense of scale. The desired tonality of the headphone dictates the wood selected, not aesthetics.

Features

The TWH alters the tonality of the music by altering it's resonant chamber. For the user, changing the cup material would be difficult. Therefore, the changing of the resonant chambers is accomplished by the usage of tone ports.

A tone port, FIG. 3, is constructed of a particular tone wood and port size to provide a desired characteristic. The user of the TWH has the ability to remove four fasteners and adjust the tonality of the TWH based on a range provide by the designer of the TWH. The wood used in the body, volume of the body, and the desired tonality range all contribute to the port wood and port sizes provided. Therefore, unlike other headphones that have a set tonality, the TWH has a range of tonalities through the usage of tone ports.

Because sound pressure is radiated forward and backwards from a transducer, the reflections off the rear chamber wall, are sufficient to change the tonality of the headphone cup.

It can be seen from the above discussion that the THW differs from other headphones in the following areas:

1. Inclusion of a port at the back of the headphone cup.
2. Construction of tone woods for a desired tonality.
3. Volume and wood chosen is designed to create a resonant chamber.
4. Changeable tone wood ports that allow the altering of the tonality of the headphone.

What is claimed is:

1. A tone wood headphone cup (TWC) which is the part that holds the transducer and provides for attachment to the a headband, designed for transducers ranging in size from 35 mm to 55 mm with diaphragms made from film or fibers, not to include electrostatic or planer transducers; whose body is designed to be mated to ear pads that sit on the ear or over the ear, not to include ear buds or in ear monitors; constructed in such a manner that the space in the cup behind the driver is configured to support the transducer's full range of frequency response in a semi-closed chamber by providing the required volume of air that has the same or nearly the same compliance as the transducer's suspension while said chamber also functions as a resonant chamber whose back wall is ported and is interchangeable by the user so that the user can alter the tonality of the audio signal or music by altering the amplitude and frequency range of the sound waves resonating in the chamber, (much like a guitar, violin, cello, or piano body), while having minimal effect on the transducer itself, said cup and back wall is made from tone wood(s) known for their tonal properties.

2. A Tone Wood headphone Cup (TWC) as in claim 1 wherein said TWC is made from one or more woods specifically selected such that the resonant frequency of the wood(s) of the cup body can be excited by the sound pressure back waves coming from the back side of the transducer in a controlled manner to support the resonant chamber created by the cup body and ported back wall, that allows for the amplification of the audio midrange and lower treble frequency ranges by the resonant chamber that lies between the transducer and ported back wall; said cup size is limited by modern headphone ergonomics, but testing has shown that for transducers between 35 mm and 55 mm the inside diameter of the cup should be close to the size to the transducer's housing to expose as much of the back side of the transducer as possible and the distance from the transducer to the back wall ranges from 35 mm to 41 mm in order to properly support the transducer's full range frequency response in a semi-closed chamber by providing the required volume of air that has the same or nearly the same compliance as the transducer's suspension; the thickness of the cup ranges between 5 mm to 6 mm in order to provide the strength to support the weight of the transducer without being so heavy as to limit the effectiveness of the resonant chamber the front of the chamber is braced by the transducer body and the rear of the chamber is braced by the internal mounting ring.

3. A Tone Wood headphone Cup (TWC) as in claim 1 wherein the back wall of the chamber behind the transducer is made with tone woods between with a thickness ranging from 2 mm to 3 mm thick and is ported so that the port hole size enables the transducer to achieve the lower end of its frequency response similar to a ported speaker, said port sizes for 40 mm transducers, range from 12 mm to 19 mm and for 50 mm transducers port sizes ranges 19 mm to 22 mm; said back wall also contains bracing of 2 mm to 3 mm thick aluminum or copper inside the chamber via the mounting ring and the port cover outside the chamber; said bracing not only ensures proper mounting of the back wall but also controls the vibrations of the back wall by adding stiffness.

4. A Tone Wood headphone Cup (TWC) as in claim 1 wherein the back wall of the chamber is interchangeable by the user with a wall made from tones woods whose density and port sizes function together in a controlled manner to allow the user to change the resonance of the chamber in a predetermined manner that has limited impact on the frequency response of the transducer but provides for varying levels of increased amplification from the resonant chamber of the audio midrange and lower treble frequency ranges based on the tone wood used and the port size allowing for airflow into and out of the resonant chamber; the interchangeability of the tone disc is made possible by an internal mounting ring and holes in a tone disc, through which screws are placed and tightened into the threaded holes in the mounting ring.

* * * * *